US007984750B2

(12) United States Patent
Pederson et al.

(10) Patent No.: US 7,984,750 B2
(45) Date of Patent: Jul. 26, 2011

(54) BINDER DEGRADATION OF SAND CORES

(75) Inventors: Thomas C. Pederson, Rochester Hills, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 424 days.

(21) Appl. No.: 12/270,952

(22) Filed: Nov. 14, 2008

(65) Prior Publication Data

US 2010/0122791 A1 May 20, 2010

(51) Int. Cl.
*B22C 1/22* (2006.01)

(52) U.S. Cl. ..... 164/527; 164/525; 164/526; 164/528; 523/145

(58) Field of Classification Search ..... 164/525–528; 523/139–148
See application file for complete search history.

(56) References Cited

U.S. PATENT DOCUMENTS

| | | | | |
|---|---|---|---|---|
| 2,975,494 | A | 3/1961 | Cooper | |
| 3,066,365 | A | 12/1962 | Moore | |
| 4,162,238 | A | 7/1979 | Bergman | |
| 4,248,974 | A | 2/1981 | Fuji et al. | |
| 4,265,665 | A | 5/1981 | Bedell | |
| 4,269,256 | A | 5/1981 | Nakazawa et al. | |
| 4,362,203 | A | 12/1982 | Konii et al. | |
| 4,584,328 | A | 4/1986 | Madono | |
| 5,318,092 | A | 6/1994 | Andrews | |
| 5,320,157 | A | 6/1994 | Siak et al. | |
| 5,621,036 | A | 4/1997 | Geoffrey et al. | |
| 5,787,958 | A | 8/1998 | Shivkumar et al. | |
| 6,920,911 | B2 | 7/2005 | Sargent et al. | |
| 2005/0004257 | A1 * | 1/2005 | Gernon et al. | 523/139 |
| 2005/0009950 | A1 * | 1/2005 | Dando | 523/139 |

FOREIGN PATENT DOCUMENTS

CA 1200655 A * 2/1986

* cited by examiner

*Primary Examiner* — Kuang Y Lin
*Assistant Examiner* — Kevin E Yoon
(74) *Attorney, Agent, or Firm* — Reising Ethington P.C.

(57) ABSTRACT

A sand core is prepared for use in defining a surface of a cast metal article. The core is formed of sand particles bonded with a polyurethane resin, preferably a polyol moiety-containing polyurethane resin. An alkali metal hydroxide, and optionally a glycol, is mixed with precursors of the polyurethane before they are mixed with sand particles for molding and curing the core. The hydroxide and glycol may be encapsulated to prevent interference with core molding. The hydroxide and glycol is distributed in the polyurethane binder resin and used to reduce the decomposition temperature of the core binder during casting. This practice is particularly useful in removing core sand from castings of light metal, lower casting temperature metal alloys.

16 Claims, 1 Drawing Sheet

BINDER DEGRADATION OF SAND CORES

TECHNICAL FIELD

This invention pertains to the use of polyurethane resin bonded sand cores in the casting of metal articles. The invention is particularly applicable to the resin degradation of sand cores in the casting of aluminum alloys and other metal alloys having melt casting temperatures lower than casting temperatures for cast iron. More specifically, this invention pertains to the use of chemical reactants (which may be encapsulated) mixed with the polyurethane binding resin of the sand core for lower temperature resin degradation of the core at such lower metal casting temperatures.

BACKGROUND OF THE INVENTION

Production of metal castings with an internal void space is commonly achieved by including a resin-bonded sand structure, called a sand core, which has the shape of the desired void space and is suspended at the desired location within the casting cavity prior to metal fill. As molten metal enters the mold cavity (for example, a sand mold cavity) it flows around the sand core and begins its solidification in the forming of an engine block or other cast article. The heat of the metal is intended to decompose the binder of the sand core after a solid cast skin has formed against the core to duplicate the shape of the core.

Organic-based materials are commonly used as binders for the sand particles in sand cores for the explicit purpose of undergoing thermal degradation to allow removal of the sand particles from the solidified casting by mechanical shaking. Cast iron alloys are often poured at temperatures in excess of 1000° C. but aluminum alloys are often poured around 700° C. The temperatures experienced by the cores may be a few hundred degrees lower. Failure to achieve sufficient degradation, often encountered when casting aluminum alloys, can make the shake-out of sand core material very difficult to complete. This results in the need to employ further time-consuming and costly processes such as a prolonged heat treatment and/or very intensive mechanical impacting and shaking to disaggregate the interior cores.

Polyurethane polymers are currently a commonly used core binder material in automotive vehicle manufacturer foundry operations owing to their good bonding strength and rapid molding cycle times when using the gas-catalyzed process, referred to as a "cold box" method. The gaseous catalyst for this process is a volatile organic base such as triethylamine. Also, there are similar polyurethane binder systems being employed which use a liquid amine catalyst and are called "no-bake" processes. The basic polymer chemistry is the same for both methods involving the reaction of an isocyanate prepolymer with a polyol when exposed to an amine catalyst. The isocyanate component in all systems currently in use is an oligomeric form of MDI, methylene diphenyl diisocyanate. Various polyols are employed by different manufacturers, with a phenol-formaldehyde pre-resin as a component for the cold box method.

Because of the shakeout problems encountered when casting aluminum or other low-temperature melting metals, it is common practice to limit the resin content in the sand. This, however, places a limit on the strength of the core which becomes a significant disadvantage when attempting to employ very thin or elongated core geometries that can distort and lose dimensions due to softening during the casting process. Other efforts to create polyurethane core binders with better shake out capability have included chemical modifications to the polymer structure.

There remains a need for an improved practice for facilitating the timely chemical decomposition of polyurethane resin binder materials in sand cores to permit easy removal of the sand particles from a metal casting. The need is particularly acute in the manufacture of complex castings of metal alloys such as aluminum alloys and magnesium alloys and the like. Aluminum engine parts and other drivetrain parts often require the use of one or more sand cores in each casting and efficient production of such parts requires easy shakeout of the sand from each core from the solidified cast article.

SUMMARY OF THE INVENTION

Sand cores are often produced in foundries by mixing silica sand with a suitable binder quantity of polyurethane resin precursor materials. Separate streams of the polyurethane precursors may be added to and thoroughly mixed with the sand particles. For example, one stream may be a liquid polyol material, a second stream may be a suitable oligomer of MDI, and a third stream may be a catalyst such as triethylamine. Other polyol moiety-containing polyurethane precursors may be used. The amount of the total binder precursors is often, by weight, about one percent to about two percent of the sand. In most instances, neither the sand nor the precursor streams require heating above the ambient temperatures of a foundry environment. The resin and sand mixture is then molded into the desired shapes of cores and the precursors, with addition of catalyst, react to form a polymerized polyurethane binder resin film or layer between the shaped sand particles to form a core body that can be placed in a mold and then experience the flow of cast metal around the body.

In accordance with this invention, small particles, or a highly concentrated solution, of an alkali metal hydroxide are incorporated into a sand core for the purpose of promoting timely degradation of the resin bonded core after the cast metal has contacted the core and commenced suitable solidification against surfaces of the core body. Preferably (but not necessarily) the alkali metal hydroxide is mixed with a binder resin precursor stream as the precursors are being mixed with sand preparatory to molding of the core. When the selected alkali metal hydroxide particles do not promote too rapid polymerization of binder resin precursors for the mixing and sand core shaping process, the particles may be mixed "as is" with one or more portions of the precursor material. But where the hydroxide particles catalyze the polymerization (or impede it) they may be pre-encapsulated using a suitable polymeric film composition. Such encapsulation is done to permit mixing of the hydroxide particles into the resin bonded core without adversely affecting the core making process. The encapsulating polymer may be substantially the same as the binder material for the sand core, or it may be a different polymer composition having adequate thermal lability to release reactants after metal casting.

The alkali metal hydroxide may comprise, for example, one or more of lithium hydroxide (LiOH), hydrated lithium hydroxide ($LiOH.H_2O$), potassium hydroxide (KOH), or sodium hydroxide (NaOH). Some of these hydroxides may catalyze the polymerization of many polyurethane precursor systems and leave insufficient processing time to mix the reacting precursors with sand and mold a sand core. The hydroxide particles may require encapsulation in these combinations. However, as will be described below in this specification, it is found that lithium hydroxide and hydrated lithium hydroxide may be mixed with some polyurethane precursors without excessive catalytic effect so that nonencapsulated lithium hydroxide particles may be added to a polyol stream or other precursor stream being mixed with sand for core molding. Preferably the hydroxide particles, whether or not encapsulated, are of micron size with the predominate size of the encapsulated particles being in the range of about 5 to 25 microns. A quantity of the alkali hydroxide may be mixed with a polyurethane precursor stream and co-extensively mixed with the sand particles and their polyurethane binder as the sand core is formed.

It is found that the presence of the particles of alkali metal hydroxide in the resin bonded core substantially reduces the temperature that the core must experience before its polyurethane binder resin starts to degrade. When used, the thin encapsulation coating on the hydroxide particles initially isolates them from the binder resin until the core temperature starts to increase. Upon being moderately heated by cast metal, the hydroxide particles decompose their encapsulating layers and the remaining hydroxide then attacks the polyurethane binder between sand particles. Even when the cast metal is a light metal alloy with its lower casting temperature, the alkali metal hydroxide particles still promote degradation of the binder resin during solidification of the cast metal and facilitate timely removal of un-bonded sand particles from the casting.

The amount of encapsulated alkali metal particles added to the core sand as the binder precursors are being added may be determined for a particular core size and shape and casting environment by experiment or experience. Often hydroxide particle additions of about five to about twenty percent by weight of the binder material are suitable for timely degradation of a typical polyurethane binder composition during casting.

In some practices of the invention with some polyurethane resin bonded cores, a suitable quantity of one or more glycols may be used in combination with the alkali metal hydroxide. And like the hydroxide(s), consideration may be given as to whether the glycol is encapsulated or not when added to the binder precursor and sand mixture.

Other objects and advantages of the invention will be apparent from a description of illustrative embodiments which follows in this specification.

DESCRIPTION OF PREFERRED EMBODIMENTS

Figure 1:
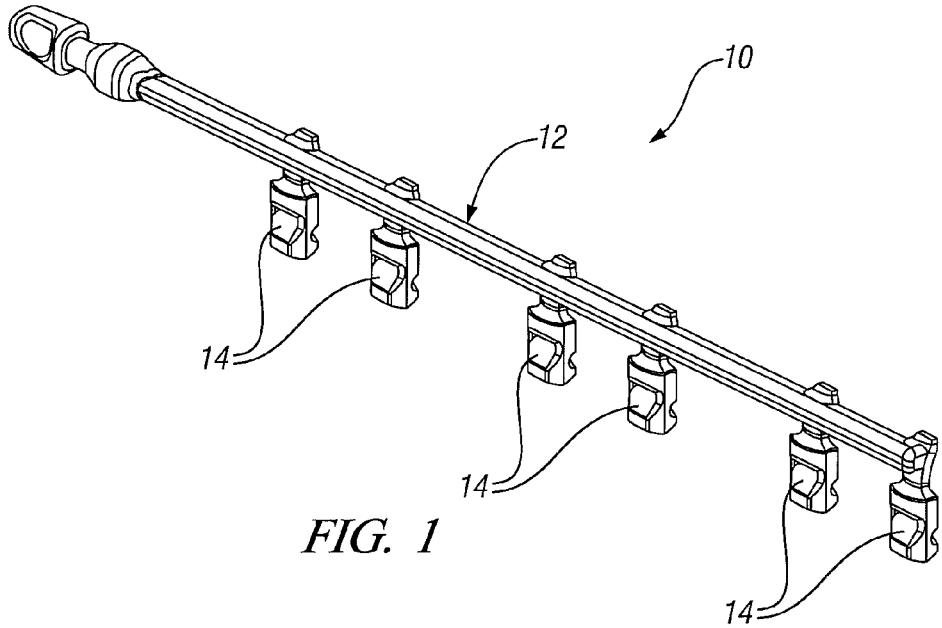
FIG. 1 is an illustration of an oil galley core used in casting an engine cylinder head casting.
Figure 2:
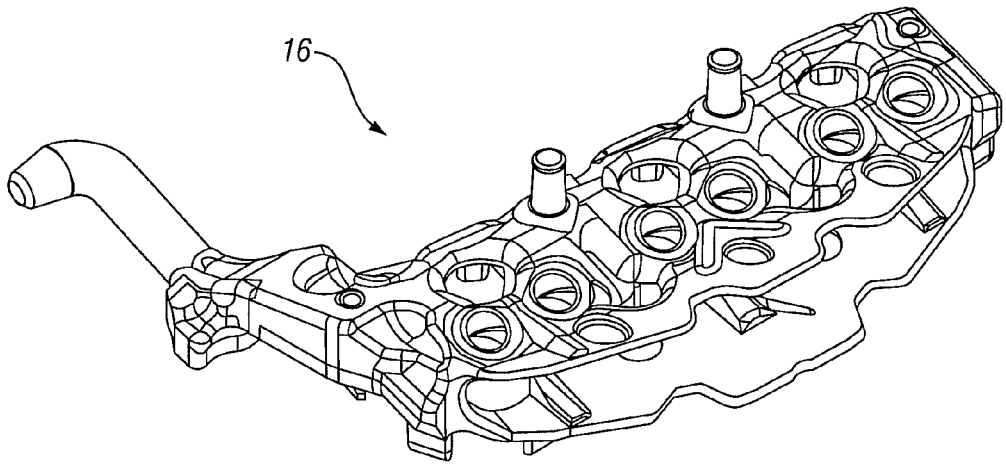
FIG. 2 is an illustration of a water jacket used in casting an engine cylinder head casting.

The casting of articles with complex shapes such as cylinder blocks, cylinder heads, and other components for automotive vehicles often requires mold bodies and cores with complex shapes. FIG. 1 illustrates an oil gallery core 10 for an engine head casting. Two oil galley cores are used to define the shapes of two pairs of oil passages for each cylinder. It is seen that each core comprises a long passage 12 for oil flow, with six side passages 14 of resin bonded sand that must degrade and be shaken out of the cast engine part. Similarly FIG. 2 illustrates a water jacket core 16 of complex shape for the flow of water-glycol coolant. Likewise, the sand from this core must be removed from a solidified casting.

Each core is made of resin bonded sand. The resin must contribute to the efficient manufacture of each core and have strength for the placement of the core in a core assembly or mold body. And the binder resin of the core must be susceptible to degradation so the core structure disintegrates sufficiently for the sand to be "shaken out" of the still hot, solidified casting. In the making of sand cores for automotive castings, polyurethane resins have gained wide acceptance because they may be readily mixed with sand and then rapidly molded and cured without need of additional heat.

The limited amount of heat in aluminum castings, as contrasted to that of iron castings, has made the post-casting shakeout of sand cores from aluminum castings very difficult because of inadequate thermal decomposition of the polymeric core binders. The work leading to this invention has investigated the possible enhancement of thermal degradation in polyurethane core binders by additives with known capability in urethane foam recycling for promoting glycolytic decomposition of the polyurethane under mild thermal conditions. But it was unknown whether such reactants could somehow be used to penetrate bonded cores and reach binder films to lower temperatures at which polyurethane bonded sand cores could be shaken out of light metal castings.

Alkali hydroxides and glycols were evaluated as sand core additives using small-scale lab bench methods to infuse the additives into polyurethane resin bonded sand samples subjected to heating at defined temperatures in a laboratory oven. In the absence of additives, significant thermal degradation required temperatures in excess of 400° C. The results with samples containing the alkali hydroxides alone or in combination with glycols clearly demonstrated enhanced binder degradation extending to temperatures as low as 200° C. The enhanced degradation was most prevalent in sand core samples with very restricted access to air which is the condition under which casting core shakeout is most difficult. Samples similarly prepared by infusion of additives into bonded cores were incorporated into small experimental castings which similarly showed enhanced post-casting degradation and shakeout. And with the use of LiOH as an additive, it was possible to incorporate the hydroxide into the pre-polymeric resin before mixing, molding, and curing of the laboratory-scale core samples. In these samples, a LiOH concentration of 5% or less by weight of the resin bonded sand exhibited enhanced thermal decomposition.

The immediately following paragraphs of the specification describe experimental work demonstrating the effect of certain alkali metal hydroxides and glycols in reducing the degradation temperature of sand cores of particular shape and made with a commercial polyurethane core binder resin. These experiments demonstrate practices of the invention. Similar experimental approaches may be used to evaluate practices as may be helpful for other core shapes and other polyurethane binder compositions.

Experimental Procedures

Since the degradation of sand core binders occurs during the period of time following metal fill when heat from the solidifying metal slowly transfers into the sand core, it was considered reasonable and practical to use laboratory oven heating of bonded sand samples as an experimental method to evaluate the effect of prospective additives. Heating the bonded sand samples for 60 minutes at temperatures varying between 200° and 500° C. in a convective lab oven was chosen as a reasonable facsimile of the amounts and duration of heating experienced in a casting. The polyurethane binder used for these experiments was HA Techniset NFZ, a "no-bake" type binder comprised of an MDI prepolymer, a polyol mixture, and a liquid amine catalyst to initiate the cure reaction. All bonded sand samples, except those described later for directly incorporating a lithium hydroxide into the resin, were prepared with a screw-type mixer to combine the resin precursors (@2% w/w) with foundry sand. This mixture was molded as a 1" thick sheet, which was later divided into the samples that were combined with experimental additives and heated in a laboratory oven.

The reactivity of powdered hydroxides or glycol reactants with the resin precursors precluded their direct addition in the resin prior to molding and curing of the bonded sand. Consequently, a laboratory method was devised to add these reactants by infusing them, dissolved in methanol, into the bonded sand samples. When the additives were dissolved in the methanol at a concentration of 2% (w/v), the amount of additive introduced into the sample was about 25% to 30% of the resin binder weight. The methanol was then removed with mild warming at reduced pressure. This left the additives inside the sand cores, presumably adsorbed, not in, but on the surface of the resin binder.

Results and Discussion

The difficulties with shakeout of aluminum engine castings encountered in automotive foundries had been described as particularly troublesome for sand cores with diminished exposure to air, in particular, the longer and thinner cores, such as those used for oil galleys (FIG. 1), implying limited access to oxygen was significant parameter affecting the binder degradation. Consequently, the laboratory oven method was conducted using comparison between bonded sand samples heated with free access to air to those having a very restricted air access. Limited access to air was imposed by tightly wrapping the sand core sample in aluminum foil. At temperatures below 400° C., in the absence of added reactants, there was little physical evidence of degradation (crumbling when subjected to finger pressure) with or without air access. However, the effect of air limitation was clearly evident at 450° C. (one hour heating) where samples exposed to air were significantly degraded while the ones with restricted air access would not similarly crumble.

Bonded sand samples containing either potassium hydroxide or lithium hydroxide monohydrate as an additive were prepared using the solvent infusion method. Control samples were prepared in which the bonded sand was infused with methanol but no additive. When subsequently subjected to heating in the laboratory oven, one set of control and hydroxide additive-containing samples was left openly exposed to air while a replicate set was tightly wrapped in aluminum foil. The beneficial effect of both KOH and $LiOH.H_2O$ on binder degradation at temperatures of 450° and 300° C. was observed. At 450° C., where only the air-exposed control sample exhibited binder degradation, the samples containing the hydroxide additives exhibited similar binder degradation with or without exposure to air. At 300° C. the degradative effect of the hydroxide additives were even more evident, as at this temperature the control samples remained strongly bonded in either the presence or absence of air. At this temperature, the improved degradation by the hydroxide additives was clearly evident in the samples that were wrapped with aluminum foil to limit air access.

Since a glycol functions as a reactant in the glycolysis process for recovery of polyols from scrap polyurethane foam, the effect of glycols, with or without the alkali hydroxide as a catalyst, was investigated over a range of oven temperatures beginning at 200° C. The oven tests were conducted at 200°, 250°, 300°, 350°, 400°, and 450° C., respectively. Tripropylene glycol was used in these tests. The tripropylene glycol was sometimes combined with potassium hydroxide. The tripropylene glycol and/or KOH, each equal to about 20% of binder weight, were incorporated into the bonded sand samples by the methanol solvent infusion method. All the sand samples were wrapped in aluminum foil to restrict air access.

The tripropylene glycol by itself had no demonstratable effect on the binder degradation. However, when added in combination with KOH, there was clearly a marked enhancement of the degradation at the lower temperatures of 200° C. and 250° C. (The amounts of glycol and/or KOH used were each equal to about 20% of the binder weights, as described earlier.) Similar results at 200° C., summarized in the Table below, were observed with a number of other glycols although magnitude of the enhancements in replicate samples were rather variable and possibly related to differences in the effectiveness of the foil wrapping, not only for limiting air access, but also for limiting the loss of the glycol by volatization, as would be anticipated by their boiling points varying from ca 230° C. to ≧300° C. The foil wrapping may also be functioning to help retain other low molecular weight polyol degradation products, which begin to accumulate and function as a solvent and aid in the dissolution and disruption of the degrading polyurethane.

| Binder degradation With glycols @ 200° C. | no KOH | KOH present |
|---|---|---|
| Control | – | + |
| Tripropylene glycol | – | +++ |
| Tri(ethylene glycol)-monomethyl ether | – | +++ |
| Di(propylene glycol)-monobutly ether | – | ++ |
| Methoxypolyethylene glycol | – | +++ |
| Poly(ethylene glycol)-monolaurate | – | ++++ |
| Octadecanol | – | ++ |

Based on the glycolysis mechanism for polyurethane foam treatment, where the glycol solvent reacts directly with polyurethane to release the polyol, the ability of KOH to enhance thermal degradation of the core binder resin without addition of a glycol seems contradictory. However, in retrospect, it is possible that the cured polymer contains some amount of unreacted polyol that functions as the glycol. Furthermore, the HA Techniset NFZ manufacturer's MSDS for the polyol formulation used in these experiments lists diethylene glycol as one of the minor components in their formulation. Some of this glycol may also remain unreacted in the cured polymer. These inferences may be of more than theoretical interest when the use of these additives are extended to polyurethane core binders from other manufactures, where the amounts of residual unreacted polyols may be quite different, and the addition of a glycol, along with the hydroxide, may be more important.

Although the methanol solvent infusion method used for the laboratory experiments is limited by uncertainties as to the distribution of the additives within the sample after evaporating the methanol, and may be impractical in a production casting process, it was employed as a method for doing a simple casting experiment.

Bonded sand core samples of 1¾ inches×4 inches×⅞ inch were prepared. One sample was infused (methanol solvent method) with tripropylene glycol, one sample was infused with potassium hydroxide, one sample was infused with both tripropylene glycol and potassium hydroxide, in amounts previously described, and one sample was a control sample with no additive. These core samples were bonded to the bottom of a casting cavity leaving a one-quarter inch space above the core samples for metal fill. The samples were affixed to one surface of a bonded sand casting cavity leaving the remaining surfaces to be enclosed within the aluminum casting. After metal fill, solidification, and cooling, the casting was removed from the mold leaving the experimental core samples within the casting. With the open surfaces of the sand cores facing down, a light amount of mechanical impact was imparted to the back of the casting. Only the sand cores containing KOH, or KOH and the glycol, were dislodged by this action. Thus, the effects of these two additives in the casting experiment are fully analogous to the results from the laboratory oven experiment described above, although there was no way to ascertain if the combined effect of the glycol plus KOH was any greater than that of KOH alone.

The catalysts employed as curing agents in the polyurethane core binders are amines, but any basic agent, even water, will initiate the polymerization reactions. Early simple attempts to add either KOH or NaOH to the mixture of MDI and the polyol gave a very rapid and visual confirmation of this. The initial reason for using LiOH was simply to take advantage of its lower formula weight. However, it was later serendipitously noted that lithium hydroxides appeared less reactive as polymerization initiators. Measurements were then made of the hydroxide's catalyst activity using defined concentrations added as a powder to the polyol component prior to mixing in the MDI resin.

A control sample of un-catalyzed mixed portions of polyol and MDI oligomer were found to polymerize in 200 minutes to a resin mixture in which the stirrer was held vertical. This sustained vertical stirrer test was the standard for timing various hydroxide-catalyzed reactions with the same amounts of polyol and MDI. When one weight percent by weight KOH was added as a finely divided powder to the precursors, one minute was required for the stirrer supporting, stiffened polymerization mixture. One weight percent finely powdered sodium hydroxide added to the polyol and MDI precursors promoted such polymerization in two minutes. When two weight percent water was added to the precursors, polymerization to the thickened state occurred in nine minutes. But when five weight percent LiOH was added 22 minutes was required to reach the stiffened state and five weight percent $LiOH.H_2O$ required 95 minutes. Thus, both the anhydrous and monohydrate forms of LiOH were much less active as polymerization initiators. The reason is likely attributable to a much lower solubility of the LiOH in the polyol prepolymer. Following tests revealed that amounts of ten percent to about thirty percent by weight of finely powdered LiOH could be added to the otherwise uncatalyzed polyol and MDI precursors without causing rapid polymerization. And the same effect was observed when like amounts of finely powdered $LiOH.H_2O$ were added to the precursors.

The practical advantage of the extended amount of time required for the polymerization catalyst activity of lithium hydroxides to take effect was that it allowed enough time for preparation of bonded sand samples at the lab bench with the hydroxide incorporated directly into the polyurethane rather than added by solvent infusion. Thus it was possible to prepare bonded sand samples with defined and uniformly distributed concentration of the hydroxides. These bonded sand samples were then used to evaluate the effectiveness of LiOH, in both anhydrous and monohydrate forms, over a range of concentrations extending much lower than had been attempted with the solvent infusion method. The results demonstrate that the enhanced thermal degradation activity was evident with LiOH concentrations of 5% or less in the polyurethane polymer.

Where one chooses to use a finely powdered alkali metal hydroxide that promotes curing of selected polyurethane binder precursors, a desired quantity of the hydroxide may be used on a separate portion of the precursors (or other encapsulating polymer material) to cure the polyurethane as an encapsulating film on the particles. The polymer-encapsulated particles may then be added to one of the polyurethane precursors being used to mold the sand core. The heat of a casting operation will melt or degrade the encapsulating polymer leaving the powdered hydroxide to degrade the sand core binder for sand removal from a solidified casting.

The practice of the invention has been illustrated with examples of some preferred embodiments that are not intended as limitations of the invention.

The invention claimed is:

1. A method of making a polyurethane resin bonded sand core for a casting process in which the core is to be contacted with cast metal in defining a surface of a casting and the polyurethane resin binder is to be decomposed by cast metal heat for removal of the core sand from the solidified casting, the method comprising:

preparing two or more streams of polyurethane resin precursor materials for addition to a mass of sand particles, the precursor materials being formulated to form a polyurethane resin bond between sand particles for the molding of a sand core for a metal casting, the polyurethane resin being intended to decompose when heated by cast metal;

adding an alkali metal hydroxide to at least one of the streams of polyurethane precursor resin materials;

mixing the polyurethane precursor streams, including the alkali metal hydroxide, with sand particles; and molding the sand particles as the precursor streams interact and cure to form a polyurethane resin bonded sand core, the composition and amount of alkali metal hydroxide particles being effective to reduce the decomposition temperature of the polyurethane resin when cast metal contacts a surface of the core.

2. A method of making a polyurethane resin bonded sand core as recited in claim 1 in which the alkali metal hydroxide is added as particles.

3. A method of making a polyurethane resin bonded sand core as recited in claim 1 in which the alkali metal hydroxide is added as polymer encapsulated particles.

4. A method of making a polyurethane resin bonded sand core as recited in claim 1 in which one polyurethane precursor stream comprises a polyol and a second precursor stream comprises MDI or an oligomer of MDI.

5. A method of making a polyurethane resin bonded sand core as recited in claim 1 in which one polyurethane precursor stream comprises a polyol and a second precursor stream comprises MDI or an oligomer of MDI and encapsulated alkali metal hydroxide particles are added to the polyol stream.

6. A method of making a polyurethane resin bonded sand core as recited in claim 1 in which the alkali metal hydroxide reactant comprises at least one hydroxide selected from the group consisting of lithium hydroxide, hydrated lithium hydroxide, potassium hydroxide, and sodium hydroxide.

7. A method of making a polyurethane resin bonded sand core as recited in claim 3 in which the encapsulated alkali metal hydroxide is entrained in a polyurethane resin.

8. A method of making a polyurethane resin bonded sand core as recited in claim 6 in which the alkali metal hydroxide particles are encapsulated in a polyurethane resin.

9. A method of making a polyurethane resin bonded sand core as recited in claim 1 in which the alkali metal hydroxide particles are encapsulated in a polymeric material susceptible to thermal decomposition under casting temperatures.

10. A method of making a polyurethane resin bonded sand core as recited in claim 6 in which the alkali metal hydroxide particles are encapsulated in a polymeric material susceptible to thermal decomposition under casting temperatures.

11. A method of making a polyurethane resin bonded sand core as recited in claim 1 in which an aluminum alloy is to be cast against the sand core.

12. A method of making a polyurethane resin bonded sand core as recited in claim 1 in which a magnesium alloy is to be cast against the sand core.

13. A method of making a polyurethane resin bonded sand core as recited in claim 1 in which a glycol is added to at least one of the streams of polyurethane precursor resin materials in addition to the alkali metal hydroxide.

14. A method of making a polyurethane resin bonded sand core as recited in claim 13 in which the glycol is encapsulated in a polymeric material susceptible to thermal decomposition under casting temperatures.

15. A method of making a polyurethane resin bonded sand core as recited in claim 1 in which the alkali metal hydroxide is added in an amount up to about twenty percent by weight of the polyurethane resin precursor materials.

16. A method of making a polyurethane resin bonded sand core as recited in claim 13 in which a glycol is added in an amount up to about twenty percent by weight of the polyurethane resin precursor materials.

* * * * *